United States Patent [19]

Buzzi

[11] Patent Number: 5,046,975

[45] Date of Patent: Sep. 10, 1991

[54] DEVICE WITH CAVITATIONAL EFFECT FOR PROPELLERS OF WATERCRAFT WITH A PLANING OR SEMIPLANING KEEL

[76] Inventor: Fabio Buzzi, Via Per Lecco 1, 22048 Oggiono (Prov. of Como), Italy

[21] Appl. No.: 333,541

[22] Filed: Apr. 5, 1989

[30] Foreign Application Priority Data

Apr. 5, 1988 [IT] Italy ..... 20092 A/88

[51] Int. Cl.[5] ..... B63H 1/18

[52] U.S. Cl. ..... 440/66

[58] Field of Search ..... 440/66, 49, 82, 61, 440/89; 416/90 A, 93 A

[56] References Cited

U.S. PATENT DOCUMENTS

| | | | |
|---|---|---|---|
| 1,470,191 | 10/1923 | Reid | 440/66 |
| 3,053,489 | 9/1962 | Robinson et al. | 440/61 X |
| 3,434,447 | 3/1969 | Christensen et al. | 440/66 |
| 4,383,829 | 5/1983 | Allen, Jr. | 440/66 X |

*Primary Examiner*—Sherman Basinger

[57] ABSTRACT

The device induces cavitation in the propeller of engine-driven watercraft with planing or semiplaning keels, thereby allowing planing speed to be attained more rapidly and greater utilization of the engine power during the transient stages before attaining the planing speed.

7 Claims, 3 Drawing Sheets

DEVICE WITH CAVITATIONAL EFFECT FOR PROPELLERS OF WATERCRAFT WITH A PLANING OR SEMIPLANING KEEL

BACKGROUND OF THE INVENTION

This invention relates to a device with cavitational effect for propellers used for propelling watercraft with a planing or semiplaning keel.

DESCRIPTION OF THE BACKGROUND ART

One of the main categories of engine-powered watercraft comprises watercraft with a planing or semiplaning keel. Such a keel enables the hull to plane when determined hydrodynamic support conditions are attained, i.e. when the weight of the hull is supported mainly by the dynamic action between the water and the keel plane.

The watercraft thus rises on the water and slides thereon instead of simply floating thereon. These planing conditions occur only at high speed, and it is therefore extremely important to as quickly as possible pass through the transient conditions between the moment in which the hull simply floats, not having as yet attained the speed required for planing, and the moment in which it planes.

It is apparent that the duration of this transient period depends on the ability to fully use the engine power. As these watercrafts use a propeller propulsion system, the problem of the duration of the transient period corresponds to solving the problem of optimising the propeller operation.

Increasing the propeller speed is known to create certain problems, deriving from the fact that to develop maximum thrust the water must slide over the propeller blades with as little turbulence as possible so that a vacuum is created on the front face. If the propeller is accelerated such that this vacuum is less than that exerted overall by the water, the flow alters to give rise to the phenomenon of cavitation, which results in a rapid reduction in the torque absorbed by the propeller and an even greater accentuated reduction in the developed thrust.

The propeller thrust is greater if the volume and speed of the mass of water which traverses the propeller disc per unit of time, are higher and its acceleration is lower. Many types of propellers and many types of propeller-engine couplings have been studied to optimise the propulsion efficiency of a watercraft in accordance with its keel shape and speed.

In the case of planing or semiplaning keels, propellers of high speed type are frequently used to ensure the high speed required for planing is obtained.

Before the watercraft has reached the speed required for planing, such propellers are not in a state of optimum operation because they are rotating at low r.p.m. and cannot be raised rapidly to the required r.p.m. Current marine propulsion units do not in fact comprise change-speed gears so that the propeller drive torque can only adapt to the resistant torque if the drive torque is always greater than the resistant torque. This means that the engine r.p.m. must be increased gradually, and only when the planing speed for the watercraft is reached can it operate under optimum maximum drive torque conditions.

The methods used up to the present time to solve this problem are not however totally satisfactory and new solutions are continuously sought by experts of the art, especially for high-speed or competition craft for which the time required for attaining planing speed is very important.

SUMMARY OF THE INVENTION

It has now been found possible to utilize the cavitational effect itself to satisfactorily solve, or at least to better solve than in the case of previously adopted solutions, the problem of utilizing maximum engine torque and its use in attaining the planing speed for a watercraft with a planing or semiplaning keel within a short time.

According to a basic characteristic of the invention, the device which enables the cavitational effect caused by the movement of a propeller to be utilized in reducing the time required to attain optimum engine power consists of a duct which enables air withdrawn from above the hull water line to directly reach the front part of the propeller.

The air is drawn through the device of the invention and on reaching the vicinity of the propeller, it causes it to cavitate and reduce the water flow through the propeller, thereby reducing the resistant torque and causing the engine r.p.m. to immediately rise. By gradually reducing the air quantity drawn through the device, it is therefore possible to keep the engine r.p.m. at maximum torque level and to regulate the thrusting rate of the propeller. Maximum torque for the entire time required to attain planing can be used and thus, optimum operating conditions for the engine-propeller unit are obtained.

In this manner, the operating conditions are considerably more favorable than those permitted by conventional solutions in which the engine r.p.m. is gradually raised to attain maximum torque only when hydrodynamic planing conditions are reached.

If the device of the invention is installed in a watercraft with two or more propellers, it will comprise an air flow duct in correspondence with each propeller present. The ducts are rigid with each other to form an integral body.

According to a further characteristic of the invention, the ratio of the cross-section of the air flow duct to the area of the disc generated by the propeller is between 1:5 and 1:50.

It is apparent to the expert of the art that a large number of embodiments of the device according to the invention are possible and these can be easily adapted to any engine type and power and to any form of planing or semiplaning keel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Some preferred embodiments of the device according to the invention are described hereinafter with particular reference to the accompanying drawings which are given by way of illustration only, and thus are not limitative of the present invention, and in which.

DESCRIPTION OF THE PREFERRED EMBODIMENTS

Figure 1:
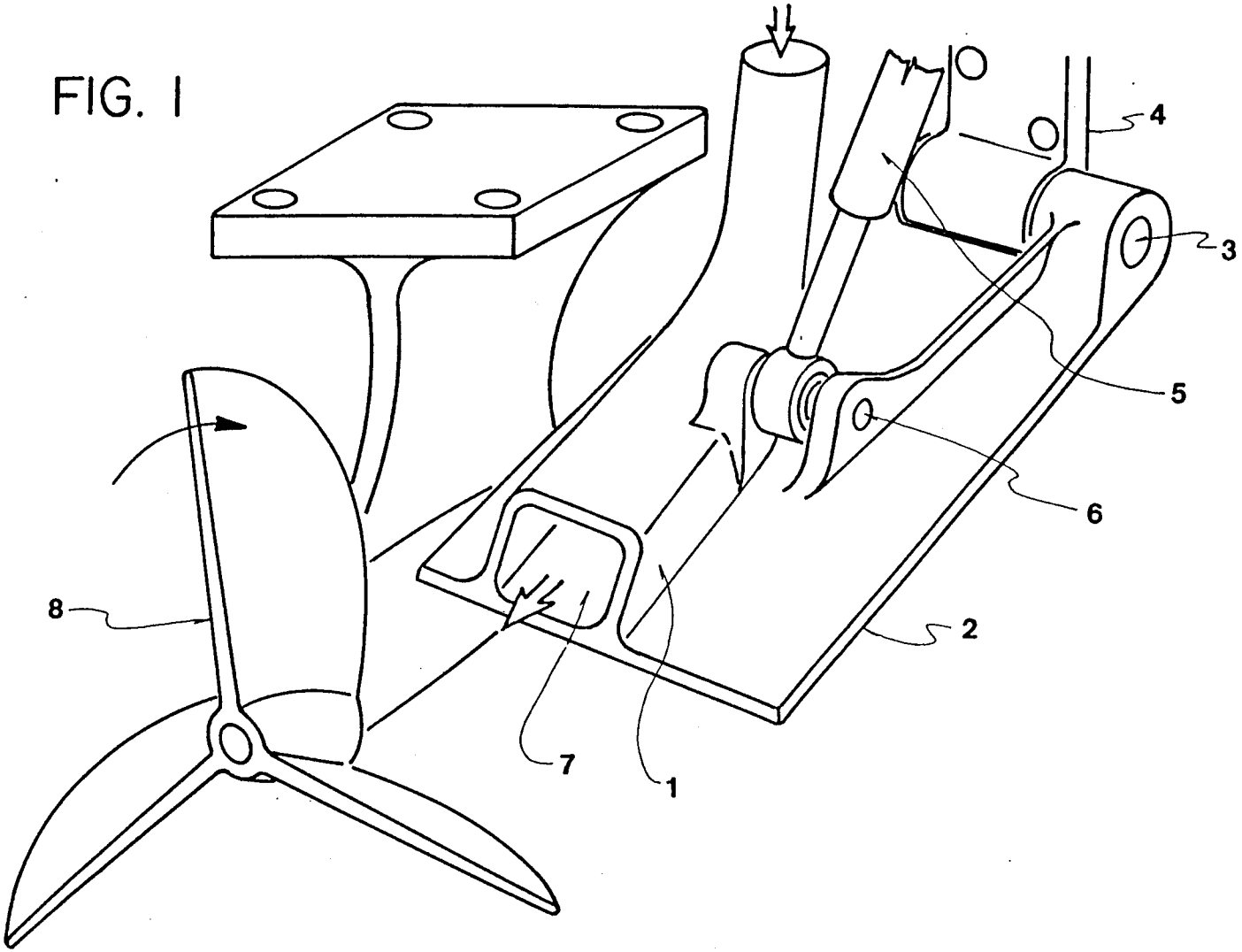
FIG. 1 is a diagrammatic view of a device mounted on the stabilizer or flap and also showing the corresponding propeller.

The device consists of a duct 1 rigid with a stabilizer or flap 2 connected by the pin 3 to a support 4 which serves to fix the device to the hull of the watercraft (not shown in the figure).

A hydraulic cylinder-piston unit 5 fixed to the stabilizer or flap 2 by a pin 6 enables the stabilizer or flap 2 to be moved about the pin 3 and thus, the air flow outlet mouth 7 to be moved relative to the propeller 8. By suitably adjusting the inclination of the stabilizer or flap 2 by means of the cylinder-piston unit 5, it is therefore possible to control at will the air flow drawn in above the water line by the movement of the propeller 8.

Figure 2:
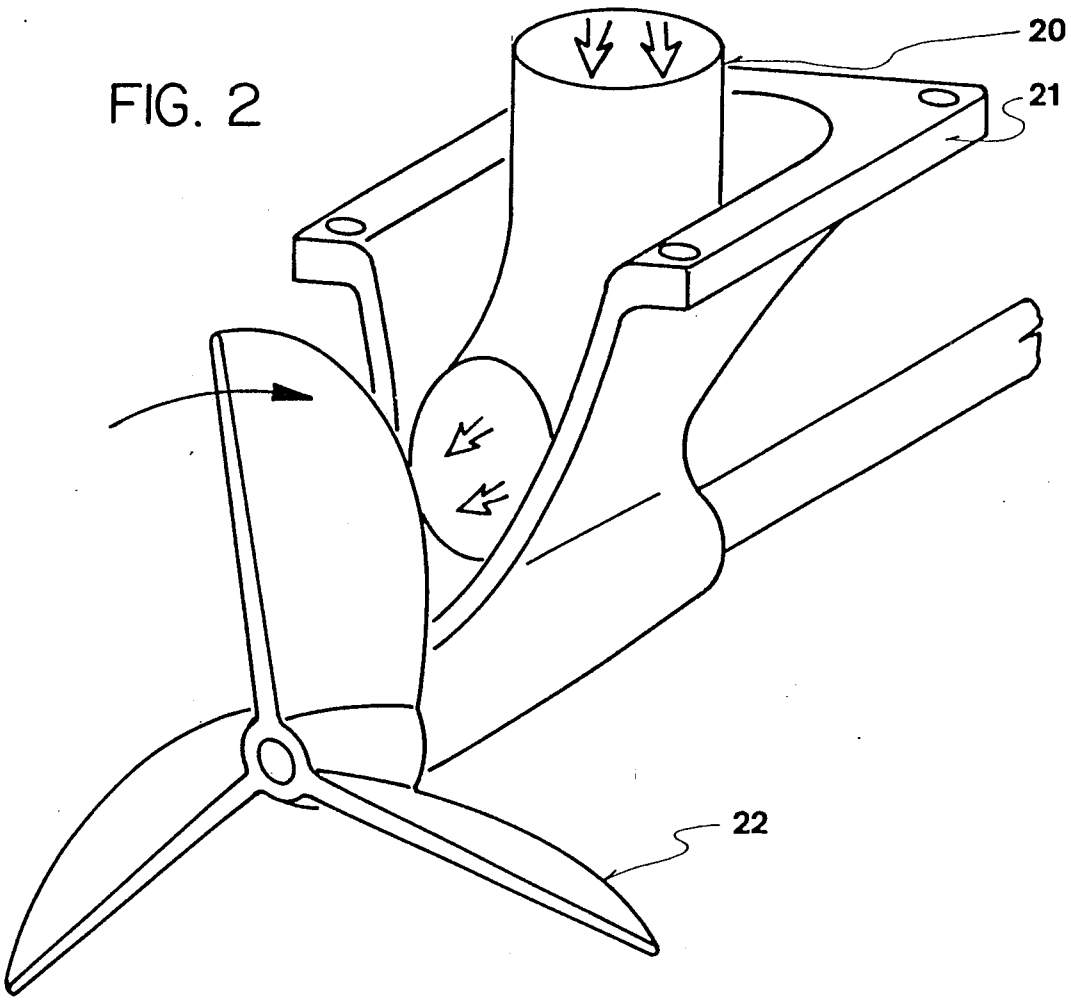
FIG. 2 is a diagrammatic view of a device mounted in a fixed manner on the support of the corresponding propeller.

In FIG. 2, the device 20 consists of a tube fixed to the support 21 for the propeller 22. The coupling propeller support is suitably shaped to be able to also support the tube. The top of the tube 20 communicates with atmosphere above the water line and therefore enables the air to flow therethrough. The air is drawn in by the movement of the propeller. The air flow to the propeller is controlled by a valve (not shown in the figure) disposed at the top of the tube 20.

Figure 3:
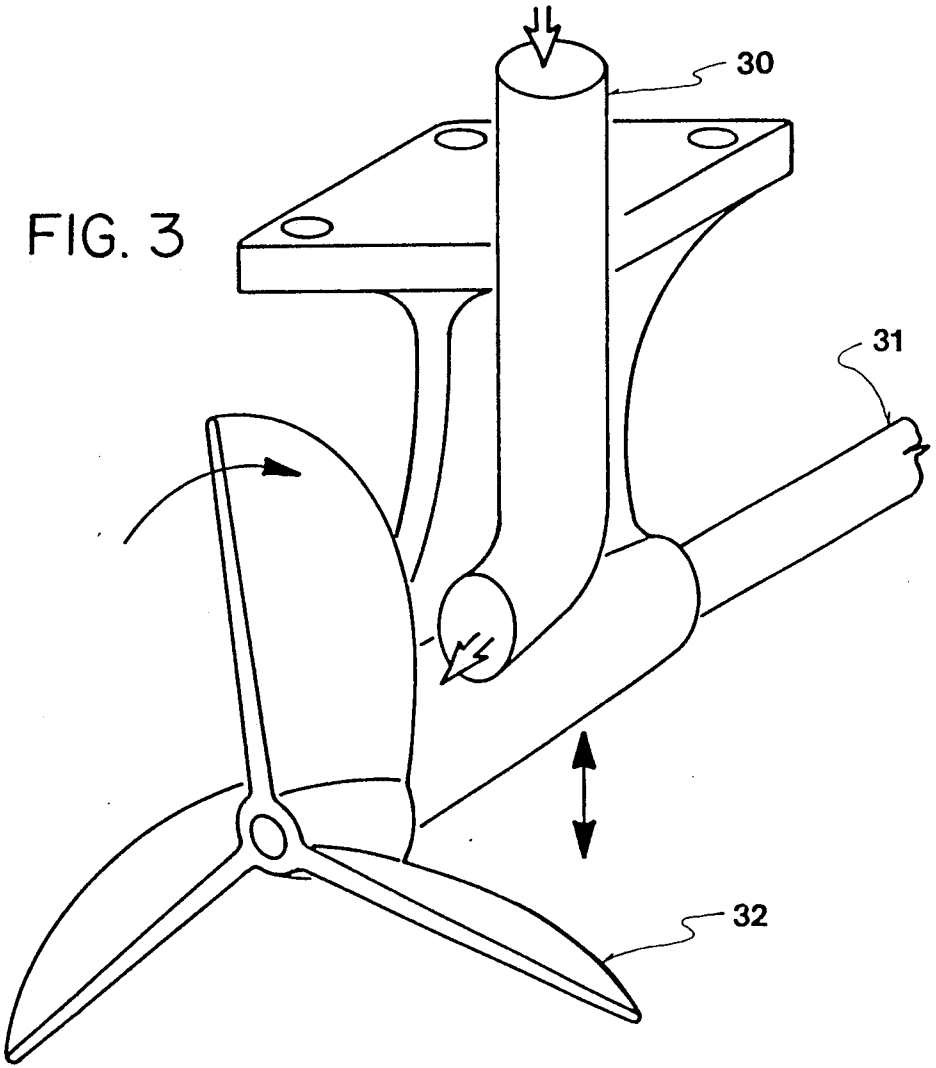
FIG. 3 is a diagrammatic view of a device which is displaceable vertically relative to the corresponding propeller.

In FIG. 3, the device consists of a duct 30 which can move vertically so that, when totally lowered, it stands immediately above the shaft 31 of the propeller 32. When totally raised, the duct 30 lies above the upper edge of the circle described by the propeller 32. The top of the duct 30 is always in communication with the atmosphere above the water line. The amount of air drawn in by the propeller 32 and flowing onto the front of the propeller is controlled by raising or lowering the duct 30.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A device with cavitational effect for propellers used for the propulsion of watercraft with a planing or semiplaning keel, the propellers having blades and the device comprising a readily movable air flow duct which enables air withdrawn from above the hull water line to directly reach a front part of the propeller, said duct having an outlet which is positionally adjustable relative to the propeller such that the point at which the air reaches the propeller is positionally adjusted along the diameter of said propeller from at least a central portion of the diameter of the propeller to a position beyond tips of the blades of the propeller.

2. The device as claimed in claim 1, wherein a ratio of cross-section for the air flow duct to an area of a disc generated by the propeller is between 1:5 and 1:50.

3. The device as claimed in claim 1, wherein the air flow duct is affixed to a flap connected to the watercraft hull by a pin which enables the duct to be moved, with consequent variation in positioning of the outlet of the duct relative to the propeller.

4. The device as claimed in claim 3, further comprising a hydraulic cylinder-piston unit operatively connected to the flap and the watercraft, operation of said hydraulic cylinder-piston unit moving said flap and the outlet of the air flow duct.

5. The device as claimed in claim 1, wherein movement of the duct to a lowest position places the outlet immediately above a shaft of the propeller and movement of the duct to an uppermost position places the outlet above an upper edge of a disc generated by the propeller, the top of said duct being in communication with the atmosphere above the water line.

6. The device as claimed in claim 1, wherein the outlet of the duct is positionally adjustable by vertical adjustment of the duct.

7. The device as claimed in claim 1, wherein the outlet of the duct is positionally adjustable by pivoting of the duct.

* * * * *